US005345211A

United States Patent [19]

Muramatsu et al.

[11] Patent Number: 5,345,211

[45] Date of Patent: Sep. 6, 1994

[54] CONNECTION BOX FOR FUSIBLE LINKS AND TERMINAL NUT

[75] Inventors: Kenji Muramatsu; Mitsuhiko Totsuka; Toshiharu Kudo, all of Shizuoka, Japan

[73] Assignee: Yazaki Corporation, Tokyo, Japan

[21] Appl. No.: 92,904

[22] Filed: Jul. 19, 1993

[30] Foreign Application Priority Data

Jul. 20, 1992 [JP] Japan ..... 4-056183[U]
Apr. 16, 1993 [JP] Japan ..... 5-112406

[51] Int. Cl.[5] ..... H01H 85/02

[52] U.S. Cl. ..... 337/186; 337/208; 337/263; 439/621; 361/671

[58] Field of Search ..... 337/208, 209, 210, 187, 337/188, 189, 190, 191, 192, 216, 262, 263; 439/621, 622; 361/671; 174/53

[56] References Cited

FOREIGN PATENT DOCUMENTS 63-82347 5/1988 Japan .
63-82348 5/1988 Japan .

*Primary Examiner*—Lincoln Donovan

*Attorney, Agent, or Firm*—Sughrue, Mion, Zinn, Macpeak & Seas

[57] ABSTRACT

An object of the present invention is to provide a connection box for plural kinds of fusible links each having different dimensions wherein the connection box is constructed in such a manner as to allow the respective fusible links to be firmly fitted to the connection box with excellent stability. The connection box for plural kinds of fusible links is integrally molded of a heat-resisting synthetic resin and includes a horizontal box-shaped portion and a vertical wall portion as essential components. An opposing pair of common slots are formed through a bottom wall of the horizontal box-shaped portion while extending not only in parallel with each other but also in parallel with the opposite side walls defining a peripheral wall of the horizontal box-shaped portion. The interior of the peripheral wall is stepwise recessed so an to enable plural kinds of fusible links each having different dimensions to be received therein. In the shown case, two kinds of inner peripheral walls are formed inside of the peripheral wall of the horizontal box-shaped portion so as to receive two kinds of housings for the fusible links herein.

3 Claims, 6 Drawing Sheets

N–N

A—A

CONNECTION BOX FOR FUSIBLE LINKS AND TERMINAL NUT

BACKGROUND OF THE INVENTION

1. Field of the Invention

The present invention relates generally to a connection box for fusible links. More particularly, the present invention relates to a connection box employable for at least two kinds of fusible links each having different exterior dimensions to be used for the purpose of protecting a power supply source circuit. Further, the present invention relates to a terminal nut to be secured to a connection box of the foregoing type.

2. The Prior Art

Various kinds of fusible links each having different exterior dimensions corresponding to a rated electric current have been hitherto practically used for a vehicle such as an automobile or the like. Particularly, a plurality of fusible links each usable for the purpose of protecting electrical circuits in an automobile and having different dimensions have been used corresponding to plural kinds of rated electric currents per each automobile. In the circumstances as mentioned above, it is necessary that at least two kinds predetermined dimensions are inevitably prepared for a connection box for fusible links having lead wires attached thereto to make electrical connection between a battery supply source and an electrical equipment. This fact will readily be understandable by making dimensional comparison between a small-sized connection box accompanied by a fusible link and a large-sized connection box accompanied by a fusible link with reference to FIG. 1 and FIG. 3. Incidentally, FIG. 1 shows by way of perspective view a small-sized connection box and a fusible link to be received in the latter, and FIG. 3 shows by way of perspective view a large-sized connection box and a fusible link to be received in the latter.

Prior to detailed description, general structure of a connection box and a fusible link to be received in the latter will briefly be described below. In FIG. 1 and FIG. 3, reference characters Ca and Cb designate fusible links, respectively. The fusible link Ca is composed of a parallelpiped-shaped housing 110*a* molded of a synthetic resin and having an inverted U-shaped fuse received therein, two feet 122*a* made of an electrical conductive material and extending downward of the housing 110*a* in parallel with each other, and a transparent cover 112*a* fitted onto the upper end of the housing 110*a*. Likewise, the fusible link Cb is composed of a parallelpiped-shaped housing 110*b* molded of a synthetic resin and having an inverted U-shaped fuse received therein, two feet 122*b* made of an electrical conductive material and extending downward of the housing 110*b* in parallel with each other, and a transparent cover (not shown) fitted to the upper end of the housing 110*b*. With respect to the small-sized fusible link Ca as shown in FIG. 1, inverted U-shaped cutouts 123 are formed at the lower end parts of the feet 122*a*. After the fusible link Ca is inserted into a connection box 103*a*, the feet 122*a* are placed on bosses b each having a female-threaded hole formed therethrough on central walls I as if the fuse is bridged between both the bosses b. In addition, terminals A of lead wires connected to a power source and an electrical equipment are located in alignment with the female-threaded holes formed through the bosses b, and subsequently, bolts D are inserted through the terminals A and threadably fitted into the female-threaded holes, whereby the terminals A are firmly secured to the central walls I to make electrical connection between both the lead cables via the fuse.

As typically shown in FIG. 2 that is a vertical sectional view of an assembly of the housing 103*a* and the fusible link Ca as shown in FIG. 1, the connection box 103*a* is designed in the parallelpiped-shaped configuration. Basically, a ceiling plate H and central walls I extending downward of the bottom surface of the ceiling plate H at the central part of the latter are made integral with each other, and two cavities are defined by a peripheral wall F and a partition wall G in such a manner as to allow fusible links Ca having exterior dimensions coincident with interior dimensions of each cavity to be snugly received in the cavities. In addition, two pairs of slots E each extending in parallel with each other are formed through the bottom surfaces of the cavities, i.e., the upper surface of the ceiling plate H so as enable the feet 122*a* of the terminal to be inserted therethrough. This means that the thickness of the central wall I should be set to be smaller than a distance between each pair of slots E.

The structure of the small-sized fusible link Ca and the large-sized fusible link Ca and the connection boxes 103*a* and 103*b* as shown in FIG. 1 and FIG. 3 has been described above. In this connection, in case of the large-sized fusible link Cb shown in FIG. 3, circular holes f formed through the feet 122*b* of the fuse corresponding to bosses b are substituted for the inverted U-shaped cutouts 123 of the small-sized fusible link Ca shown in FIG. 1. Thus, in practical use, the bosses b cooperate with the circular holes f. As shown in FIG. 1 and FIG. 3, each of the feet 122*a* and 122*b* of the fusible links Ca and Cb has a substantially inverted U-shaped sectional contour, and the opposite ends of each foot are inwardly bent at a right angle to form ribs 2. Each of the feet 122*a* and the feet 122*b* is dimensioned to have a width smaller than the width of each slot E.

While the aforementioned structure of the fusible links Ca and Cb and the corresponding connection boxes 103*a* and 103*b* is taken into account, exterior dimensions of the small-sized fusible link Ca and the connection box 103*a* will be compared with those of the large-sized fusible link Cb and the connection box 103*b* below with reference to FIG. 1 and FIG. 3.

A distance $Z_1$ between two feet 122*a* of the small-sized fusible link Ca shown in FIG. 1 is dimensionally coincident with a distance $Z_2$ between two feet 122*b* of the large-sized fusible link Cb shown in FIG. 3. Next, when an effective length $P_1$ of the foot 122*a* of the small-sized fusible link Ca as measured from the center of the boss b toward the housing 110*a* is compared with an effective length $P_2$ of the foot 122*b* of the large-sized fusible link Cb as measured from the center of the boss b toward the housing 110*b* while each fusible link is fitted into the corresponding connection box, the former is smaller than the latter.

Next, when the connection box 103*a* for the small-sized fusible link Ca is compared with the connection box 103*b* for the large-sized fusible link Cb, a transverse width $X_l$ of each cavity of the connection box 103*a* for the small-sized fusible link Ca as measured in parallel with a pair of slots E shown in FIG. 1 is smaller than a transverse width $X_2$ of each cavity of the connection box 103*b* for the large-sized fusible link Cb as measured in parallel with a pair of slots E shown in FIG. 3. However, a length $Y_1$ as measured at a right angle relative to the transverse width $X_1$ is dimensionally coincident with a length $Y_2$ as measured at a right angle relative to the transverse width $X_2$.

In addition, a length $x_1$ and a transverse width $y_1$ of the peripheral wall F of the connection box 103*a* for the small-sized fusible link Ca are smaller than a length $x_2$ and a transverse width $Y_2$ of the peripheral wall F of the connection box 103*b* for the large-sized fusible link Cb. Thus, the dimensional relationship between the small-sized fusible link Ca and the large-sized fusible link Cb can be represented by inequalities of $P_1<P2$, $X_1<X_2$, $x_1<x_2$ and $y_1<y_2$. P As is apparent from the above description, each conventional connection box is required to have dimensions corresponding to a fusible link to be fitted thereinto in terms of an effective foot length of the fusible link and a transverse width of a housing of the same. Especially, in case of a small-sized passenger car, a plurality of connection boxed are arranged in a narrow space in the passenger car. For this reason, there is a possibility that each fusible link fitting operation is achieved with many manhours due to the dimensional difference among a plurality of fusible links, and moreover, an insert portion of each fusible link is damaged or injured when each fusible link is fitted into the corresponding connection box. In addition, it is obvious from the viewpoint of production that a plurality of injection molding dies are prepared corresponding to the number of kinds of the fusible links, resulting in the conventional fusible links being disadvantageously employed not only from the viewpoint of a production cost of each conventional fusible link but also from the view, point of each fusible link fitting operation to be achieved at a high efficiency.

FIG. 4 shows by way of fragmentary sectional view the contour of the foot 122*b* of the large-sized fusible link Cb shown in FIG. 3 while the foot 122*b* is inserted through the slots E. As the fusible link Cb is repeatedly attached to and detached from the connection box 103*b*, a certain play appears between each rib e of the fusible link Cb and the corresponding side wall of the connection box 103*b* due to repeated rubbing operations achieved therebetween. Consequently, there is a possibility that the inverted U-shaped cutout 123 or the circular hole f is not exactly located in alignment with the boss f on the connection box side, whereby there may arise an occasion that the terminals of lead wires can not correctly be connected to each other via the fusible link, resulting in satisfactory electrical connection failing to be made between a supply source and an electricity consumer side.

Therefore, with the conventional connection box 103*a*, 103*b* constructed in the above-described manner, there arises a necessity for individually preparing a connection box corresponding to dimensions of each fusible link to be fitted thereto, i.e., an effective foot length P and peripheral wall lengths X and Y of the housing 110*a*, 110*b* wherein the foregoing dimensions vary depending on an electric current capacity of each fusible link.

In case that a plurality of connection boxes are arranged in a narrow space on a vehicle body, a wide space is inevitably required. Another problems are such that each fusible link fitting operation is achieved with many manhours due to dimensional difference among a plurality of fusible links, insert portions of each fusible link are readily damaged or injured, and a die cost associated directly with a production cost for each connection box is largely increased due to a necessity for preparing a plurality of injection molding dies.

SUMMARY OF THE INVENTION

In view of the forgoing problems, an object of the present invention is to provide a connection box for plural kinds of fusible links wherein the connection box has a new structure which makes it possible to fit the fusible links each having different dimensions to the connection box with excellent stability in contrast the conventional connection box.

The present invention has been made in consideration of the foregoing background and its object resides in providing a terminal nut for a connection box employable for plural kinds of fusible links wherein each fusible link fitting operation can be achieved at an improved efficiency.

To accomplish the above object, the present invention provides a connection box for plural kinds of fusible links including a horizontal box-shaped portion having an opposing pair of common slots formed through a bottom wall thereof while extending not only in parallel with each other but also in parallel with the opposite side walls defining a peripheral wall of the horizontal box-shaped portion and a vertical wall portion having a thickness substantially equal to a distance between both the common slots and including terminal nuts on the opposite side wall surfaces thereof, the vertical wall portion extending downward of the horizontal box-shaped portion, wherein the interior of the peripheral wall is stepwise recessed, that plural opposing pairs of transverse slot portions are formed corresponding to the number of kinds of the fusible links through the bottom wall of the horizontal box-shaped portion at the opposite end parts of the common slots so as to allow ribs formed at the opposite ends of each electrical conductive foot of each fusible link to be inserted therethrough, and that each of the transverse slot portions extends along the side wall surface of the vertical wall portion.

With the connection box constructed according to the present invention, since the interior of the peripheral wall of the horizontal box-shaped portion is stepwise recessed, plural kinds of fusible links can be received in the interior of the peripheral wall. In addition, since an opposing pair of common slots and plural opposing pairs of transverse slot portions are formed through the bottom wall of the horizontal box-shaped portion so as to allow ribs curvedly formed at the opposite ends of electrical conductive foot of each fusible link to be inserted therethrough, various kinds of foot each having a different width can be inserted through the bottom wall of the horizontal box-shaped portion with the aid of the common slots and the transverse slot portions. Further, since an assembly of each common slot and the associated transverse slot portions are formed through the bottom wall in the substantially U-shaped configuration, the foot can reliably be retained in the connection box with excellent stability.

According to another aspect of the present invention, there is provided a terminal nut for a connection box employable for at least two kinds of fusible links each having a different rated electric current capacity wherein an opposing pair of common slots are formed through a bottom wall of a horizontal box-shaped portion of the connection box so as to allow each connecting plate of one of the fusible links having ribs formed at the opposite ends of the connecting plate to be inserted through the common slots, a central wall is caused to extend downward of the bottom wall at the intermediate position between both the common slots, side walls are likewise caused to extend downward of the bottom wall in parallel with the opposite side wall surfaces of the connection box, and terminal nuts are firmly disposed between the central wall and the side walls, wherein a pair of recesses are formed on each of the terminal nuts so as to allow ribs formed at the opposite ends of each connecting plate of the smallest kind of fusible link to be inserted through the recesses.

In addition, according to other aspect of the present invention, there is provided a terminal nut for a connection box employable for at least two kinds of fusible links, wherein the recesses formed on each of the terminal nuts are recessed in the form of slits.

With the terminal nut constructed according to the present invention, when a connecting plate of one of the fusible links having ribs formed at the opposite ends thereof is inserted through one of the common slots, the lower ends of the ribs are received in the slits to make reliable electrical connection between two cables without any necessity for replacing the terminal nuts with other kind of terminal nuts. In addition, there does not arise a malfunction that tightening bolts threadably fitted into female-threaded holes are undesirably loosened due to thermal expansion of the terminal nut caused by generated heat.

DETAILED DESCRIPTION OF THE PREFERRED EMBODIMENTS

The present invention will now be described in detail hereinafter with reference to the accompanying drawings.

Figure 5:
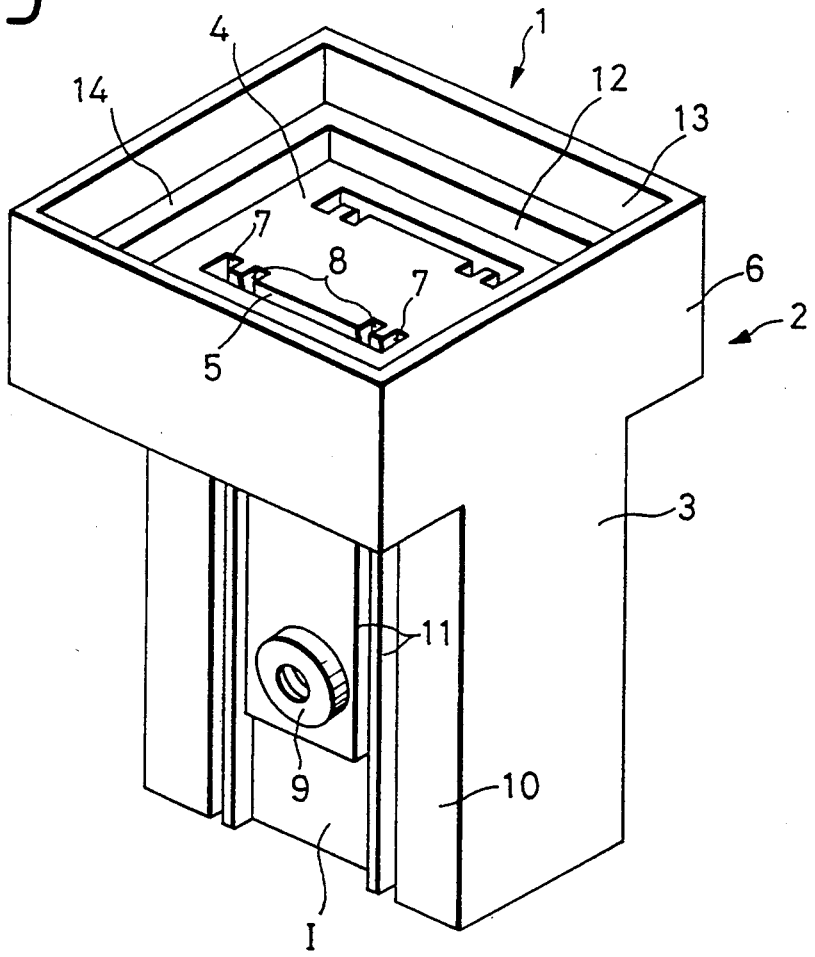
FIG. 5 is a perspective view of a connection box for fusible links constructed according to a first embodiment of the present invention.
Figure 6:
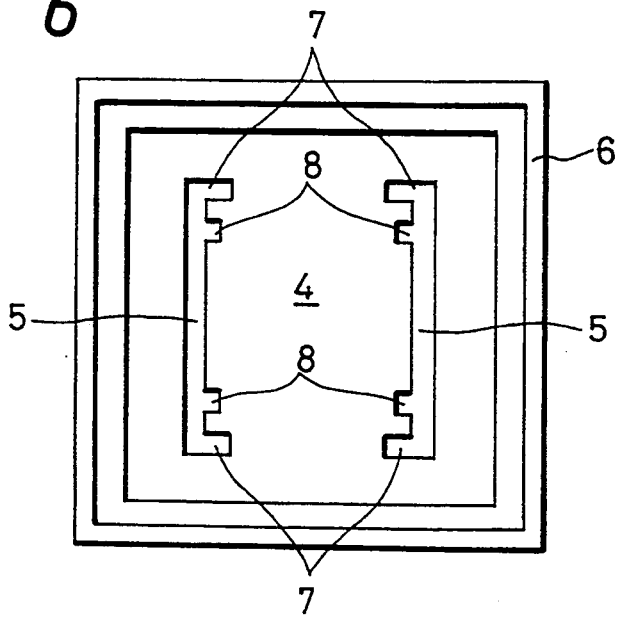
FIG. 6 is a plan view of the connection box shown in FIG. 5.

A first embodiment of the present invention will be described below with reference to FIG. 5 and FIG. 6.

Figure 1:
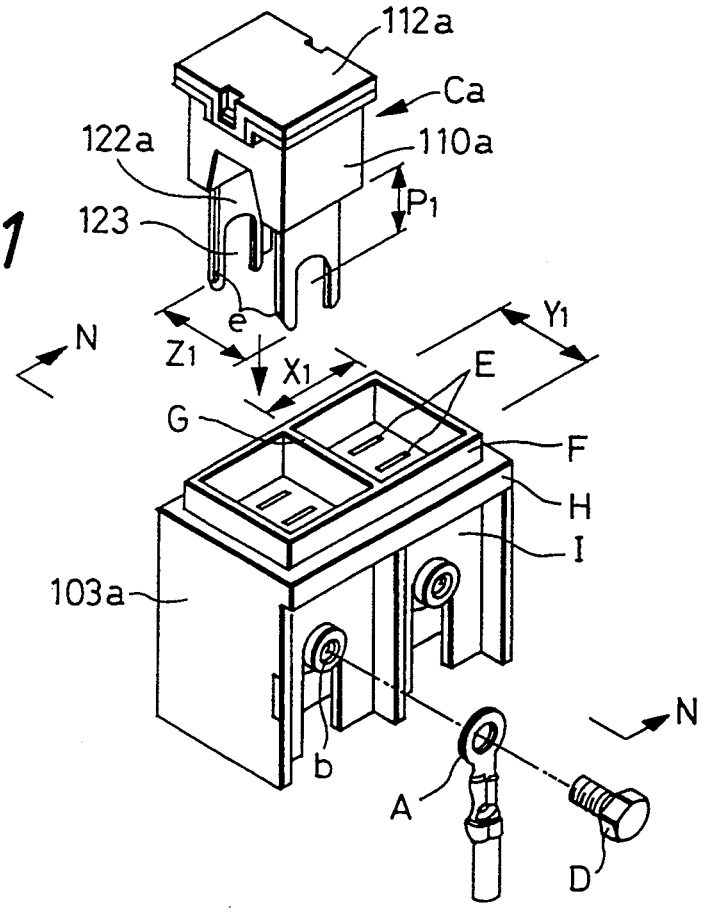
FIG. 1 is a perspective view of a conventional connection box for a small-sized fusible link, particularly showing the connection box and the fusible link in the disassembled state.
Figure 2:
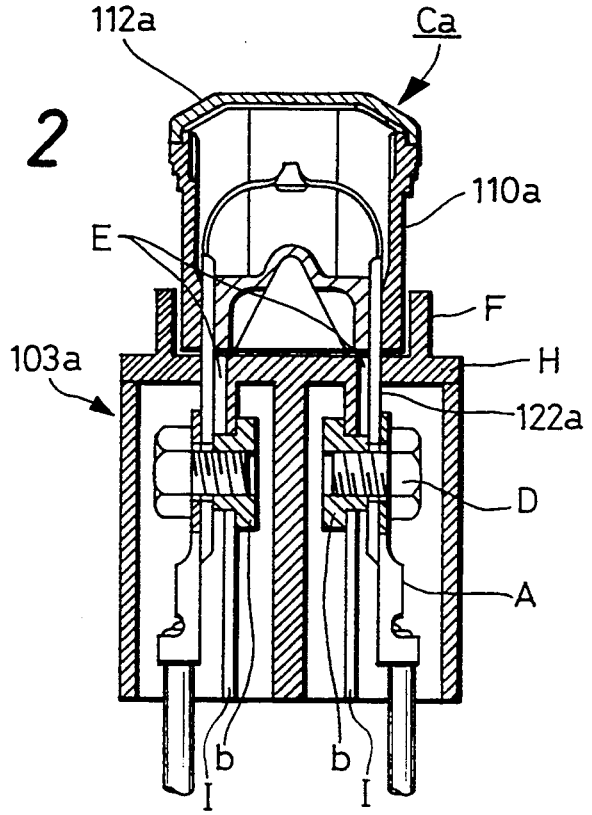
FIG. 2 is a sectional view of the connection box taken along line N—N in FIG. 1.
Figure 3:
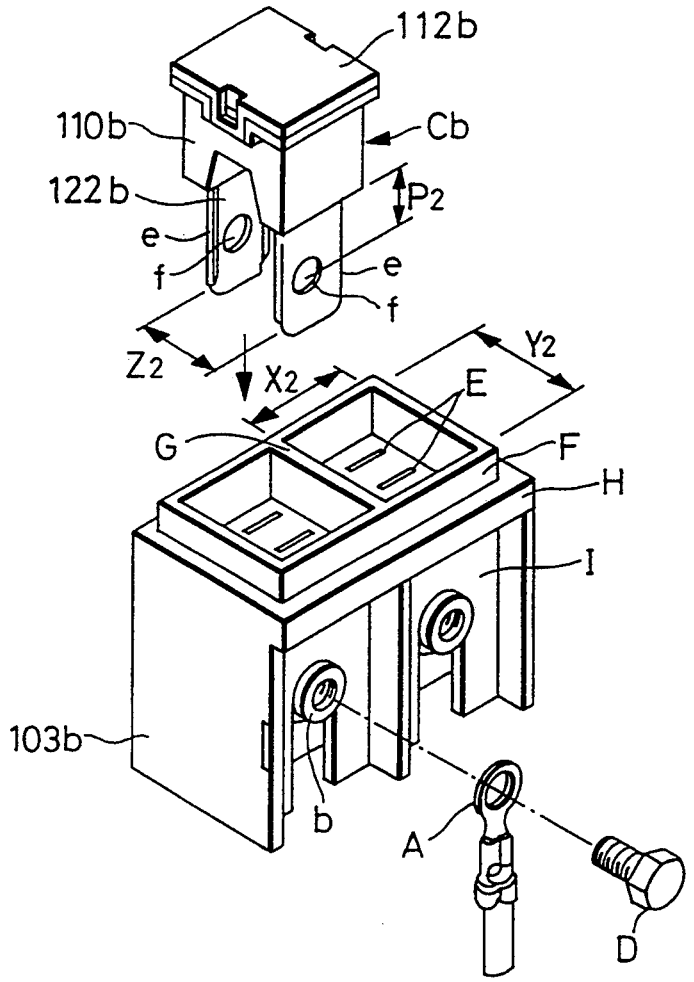
FIG. 3 is a perspective view of a conventional connection box for a large-sized fusible link, particularly showing the connection box and the fusible link in the disassembled state.
Figure 4:
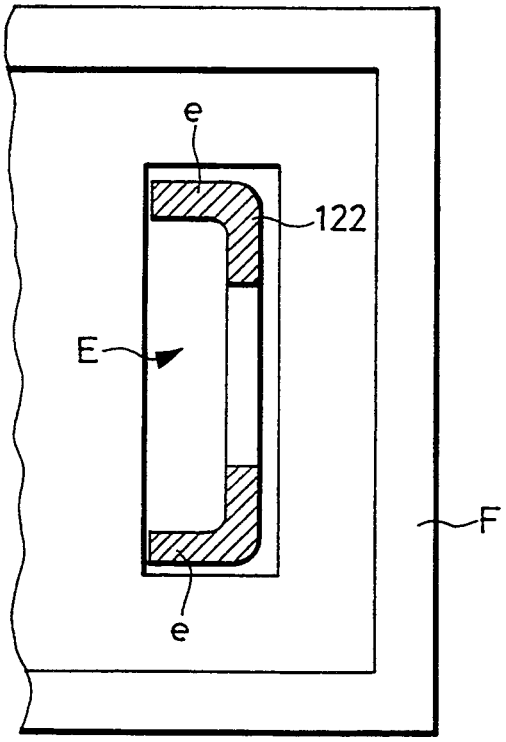
FIG. 4 is a fragmentary enlarged sectional view of the connection box, particularly showing that ribs formed at the opposite ends of each connecting plate of the fusible link shown in FIG. 3 are inserted through a bottom wall of the connection box.

As shown in the drawings, a connection box 1 for two kinds of fusible links is molded of a heat-resisting synthetic resin to exhibit an integral structure and includes a horizontal box-shaped portion 2 and a vertical wall portion 3 as essential components. The horizontal box-shaped portion 2 is designed in the parallelpiped-shaped configuration corresponding to exterior dimensions of housing 110*a* and 110*b* for small-sized and large sized fusible links Ca and Cb as shown in FIG. 1 and FIG. 3. Incidentally, since fusible links to be fitted to the connection box 1 are substantially coincident with the conventional fusible links described above with reference to FIG. 1 to FIG. 3 in structure and do not form any part of the present invention, components constituting each fusible link are represented by same reference numerals for the purpose of convenience. Thus, repeated description on these components will not be required.

An opposing pair of common slots 5 are formed through a bottom wall 4 of the horizontal box-shaped portion 2 while extending not only in parallel with each other but also in parallel with outer walls 6. To receive the housings 110*a* and 110*b* for the small-sized and large-sized fusible links ca and Cb in the horizontal box-shaped portion 2, the interior of the horizontal box-shaped portion 2 is stepwise recessed. Especially, in the first embodiment, for the purpose of convenience, the horizontal box-shaped portion 2 is designed to have two stages in order to receive two kinds of housings, i.e., housings of the small-sized and large-sized fusible links Ca and Cb each having different dimensions therein.

The vertical wall portion 3 is located below the horizontal box-shaped portion 2 while extending along the common slots 5 and has a width corresponding to the distance between both the common slots 5. As is best seen in FIG. 5, the connection box 1 exhibits a T-shaped contour in combination of the horizontal box-shaped portion 2 with the vertical wall portion 3 as viewed from the right-hand side of the drawing. Terminal nuts 9 each having a female-threaded hole formed therethrough are projected from the opposite side wall surfaces 10 of the vertical wall portion 3 so as to allow circular holes f or inverted U-shaped cutouts 123 formed in the vicinity of the free ends of feet 122*a*, 122*b* of a fusible link extending downward of the common slots 5 to be positionally aligned with the female-threaded holes. The free end parts of the feet 122*a*, 122*b* of the fusible link are fixedly secured to the terminal nuts 9 together with terminals A of lead wires extending from a supply source and an electrical equipment by threadably fitting bolts or set screws D into the female-threaded holes while each terminal A is interposed between the terminal nut 9 and the bolt or set screw D. For this reason, the surface of each terminal nut 9 should positionally be aligned with the common slot 5 in the vertical direction, and moreover, the terminal nut 9 should be projected from the side wall surface 10 of the vertical wall portion 3 at the position corresponding to the center of the common slot 5 as seen in the longitudinal direction.

As shown in FIG. 1 and FIG. 3, an opposing pair of feet 122*a*, 122*b* of the fusible link Ca, Cb usually include ribs e at the opposite end parts which are inwardly bent at a right angle relative to the feet 122*a*, 122*b* while extending in the opposite direction. As is best seen in FIG. 6, each common slot 5 includes first transverse slot portions 7 at the opposite ends thereof so as to allow the ribs e of the large-sized fusible link Cb to extend through the first transverse slot portions 7. It is obvious that the left-hand first transverse slot portions 7 are located opposite to the right-hand first transverse slot portions 7 in the symmetrical relationship relative to the vertical wall portion 3. Thus, once the feet 122*b* and the ribs e are inserted through the common slots 5 and the first transverse slot portions 7, the terminal nuts 9 are exactly located at the predetermined positions while they are correctly aligned with the circular holes f formed through the feet 122*b*. In addition, an opposing pair of second transverse slot portions 8 are formed through the bottom wall 4 of the horizontal box-shaped portion 2 at the positions offset from the first transverse slot portions 7 toward the central part of the connection box 1 corresponding to the ribs e of the feet 122*a* of the small-sized fusible link Ca. Thus, the formation of the common slots 5, the first transverse slot portions 7 and the second transverse slot portions 8 in that way makes it possible to insert the feet 122 of two kinds of fusible links Ca and Cb through the bottom wall 4 of the horizontal box-shaped portion 2, and moreover, exactly locate the terminal nuts 9 in alignment with the circular holes f formed through the feet 122.

The first and second transverse slot portions 7 and 8 extend further downward of the bottom wall 4 of the horizontal box-shaped portion 2 along the opposite side wall surfaces 10 in the form of vertically extending grooves 11. Thus, the feet 122*a*, 122*b* of the fusible link Ca, Cb can exactly be located in the connection box 1 with improved properties of the latter in respect of the reliable extension of the feet 122*a*, 122*b* in the connection box 1.

However, the feet 122*a* and 122*b* of the small-sized fusible link Ca and the large-sized fusible link Cb described above with reference to FIG. 1 and FIG. 3 are different from each other in respect of effective lengths $P_1$ and $P_2$ and exterior dimensions of the housings 110*a* and 110*b*. For this reason, to assure that a single connection box 1 serves not only for the small-sized fusible link Ca but also for the large-sized fusible link Cb, it is necessary that the inner peripheral wall of the horizontal box-shaped portion 2 has a height corresponding to the exterior dimensions of the housing 110*a* or 110*b* in addition to the aforementioned formation of the common slots 5 corresponding to the width of the feet 122*a* or 122*b*.

To cope with the foregoing problem, according to the first embodiment of the present invention, the inner peripheral wall of the horizontal box-shaped portion 2 is stepwise designed to have a lower inner peripheral wall portion 12 extending at a right angle relative to the bottom wall 4 and an upper inner wall peripheral wall portion 13 extending upward of the lower inner peripheral wall portion 12 via a horizontal stepped part 14. Thus, when the small-sized fusible link Ca is fitted to the connection box 1, a lower shoulder 124*a* of the housing 110*a* of the small-sized fusible link Ca is exactly surrounded with the lower inner peripheral wall portion 12. On the other hand, when the large-sized fusible link Cb is fitted to the connection box 1, a lower shoulder 124*b* of the housing 110*b* of the large-sized fusible link Cb is likewise exactly surrounded with the upper inner peripheral wall portion 13. Consequently, the feet 122*a* or 122*b* of the fusible link Ca or Cb can correctly be located relative to the terminal nuts 9 regardless of the exterior dimensions of the fusible link Ca or Cb.

For example, in case of the small-sized fusible link Ca as shown in FIG. 1, when it is fitted to the horizontal box-shaped portion 2 of the connection box 1, the housing 110*a* is reliably retained in the horizontal box-shaped portion 2 while it is surrounded by the lower inner peripheral wall portion 12 and the bottom wall 4. On the other hand, in case of the large-sized fusible link Cb as shown in FIG. 3, when it is fitted to the horizontal box-shaped portion 2 of the connection box 1, the lower shoulder 124*b* of the housing 110*b* is placed on the stepped part 14 while the housing 110*b* is reliably retained by the upper inner peripheral wall portion 13, since dimensions of both the long and short sides of the lower inner peripheral wall portion 12 or the upper inner peripheral wall portion 13 and the height of the same are determined corresponding to dimensions of the outer peripheral wall of the housing 110*b* and the height of the lower inner peripheral wall portion 12 is set to the dimensional difference between the effective lengths of the feet 122*a* and 122*b*, i.e., a value representing $P_2-P_1$.

To carry out practical design for the horizontal box-shaped portion 2 of the connection box 1, it is not always necessary that the lower inner peripheral wall portion 12 extends along the whole length of both the long and short sides thereof. Alternatively, the outer peripheral wall of the housing 110*b* of the large-sized fusible link Cb may be retained merely by four corners of the lower inner peripheral wall portion 12 of the horizontal box-shaped portion 2 of the connection box 1.

In case that the connection box 1 constructed according to the first embodiment of the present invention is employed for two or more fusible links each having different dimensions, it is acceptable that additional transverse slot portions are formed through the bottom wall 4 of the horizontal box-shaped portion 2, and moreover, additional inner peripheral wall portion(s) and stepped part(s) are formed along the inner wall of the horizontal box-shaped portion 2 of the connection box 1 in consideration of the dimensions of these fusible links. Thus, according to the first embodiment of the present invention, it is possible that a single connection box simultaneously serves for plural kinds of fusible links. In practical production, it is possible that a plurality of connection boxes are integrally molded in the form of a single unit having the connection boxes successively jointed to each other in the end-to-end relationship.

As is apparent from the above description, since the connection box constructed according to the first embodiment of the present invention makes it possible to simultaneously serve for plural kinds of fusible links each having different dimensions, advantageous effects attainable by the connection box of the foregoing type are such that each connection box can integrally be molded at a high efficiency and the respective fusible links can easily and reliably be fitted to the connection box by any untrained-operator at an improved operational efficiency unless he erroneously selects the kind of each fusible link to be fitted to the connection box. In addition, since each connection box is constructed such that plural kinds of feet of fusible links can be inserted through the same number of kinds of slots formed through the bottom wall of the connection box and reliably retained in the connection box with excellent stability, a plurality of connection boxes each employable for plural kinds of rated electric currents can be molded in the form of a single unit having the connection boxes successively connected to each other in the end-to-end relationship using a single injection molding die, resulting in a die cost associated directly with a production cost for each connection box being substantially reduced.

Figure 7:
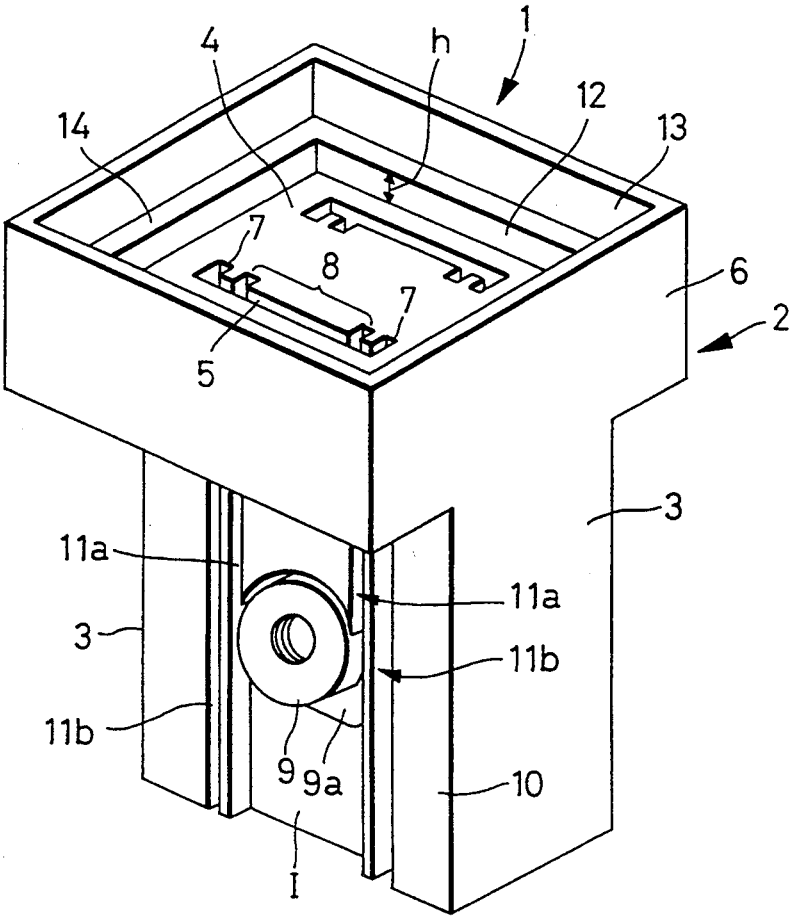
FIG. 7 is a perspective view of a connection box for fusible links constructed according to another embodiment of the present invention modified from the first embodiment of the same.

Next, another embodiment of the present invention modified from the first embodiment of the same will be described below with reference to FIG. 7 to FIG. 9. Incidentally, same components as those in the first embodiment of the present invention are represented by same reference numerals for the same of convenience.

Figure 8:
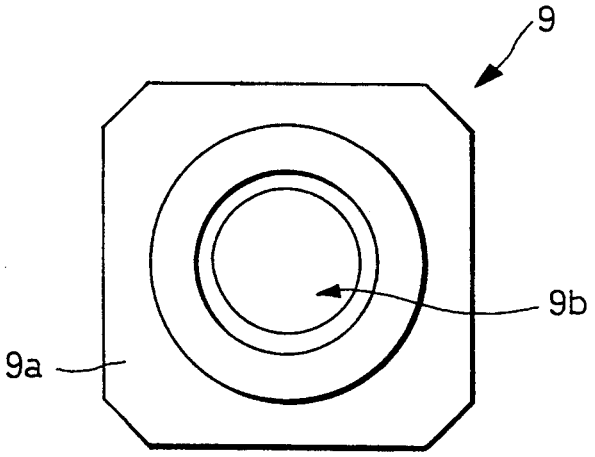
FIG. 8 is a plan view of a terminal nut to be secured to the connection box shown in FIG. 7.
Figure 9:
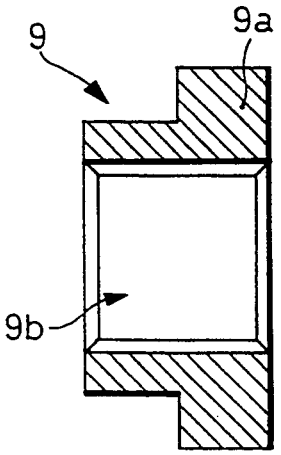
FIG. 9 is a sectional view of the terminal nut shown in FIG. 8.

A connection box 1 constructed according to this embodiment is modified from the connection box 1 described above with reference to FIG. 5 and FIG. 6 in such a manner that terminal nuts 9 each having a female-threaded hole 9*b* formed through a plug 9*a* as shown in FIG. 8 and FIG. 9 are secured to the connection box 1 at the positions between a central wall I and opposite side walls 3. Other components rather than the terminal nuts 9 are substantially same to those in the first embodiment of the present invention. Thus, repeated description on these components will not be required.

In the modified embodiment, the connection box 1 is constructed in the same manner as the first embodiment of the present invention such that it is employed not only for a small-sized fusible joint Ca usable for a low rated electric current but also for a large-sized fusible link Cb usable for a high rated electric current. It should be added that the female-threaded hole 9*b* of the terminal nut 9 is usually formed in conformity with the provisions specified for a M6 nut (having a nominal small diameter of 6 mm in accordance with JIS).

In case that the connection box 1 is employed for the large-sized fusible joint Cb, it is obvious that a high intensity of electric current flows through a cable having a large diameter while generating heat at a terminal joint location, resulting in a bolt threadably fitted into the female-threaded hole 9*b* being readily loosened with incomplete electrical connection made between two cables because of the thermal expansion of the terminal nut 9 caused by the generated heat. For this reason, when the connection box 1 is used for the large-sized fusible link Cb, a high magnitude of tightening torque is required in excess of the tightening torque required for the small-sized fusible link Ca. To meet the requirement, it is recommendable that a large nut such as a M8 nut (having a nominal diameter of 8 mm in accordance with JIS) or the like is employed for the purpose of assuring reliable electrical connection between two cables while preventing the nut from being loosened due to thermal expansion thereof. In other words, there arises a necessity for replacing the terminal nuts 9 with another ones corresponding to the kind of a fusible link to be fitted to the connection box 1, causing each fusible link fitting operation to be achieved at a low efficiency, although the connection box 1 has certain versatility.

A second embodiment of the present invention to be described later has been made to cope with the foregoing problem. The second embodiment of the present invention consists in that a terminal nut can be used for the purpose of enabling a single kind of terminal nut to be employed for fitting plural kinds of fusible links to a single connection box.

The second embodiment of the present invention will be described in more detail below with reference to FIG. 10 to FIG. 13.

Figure 10:
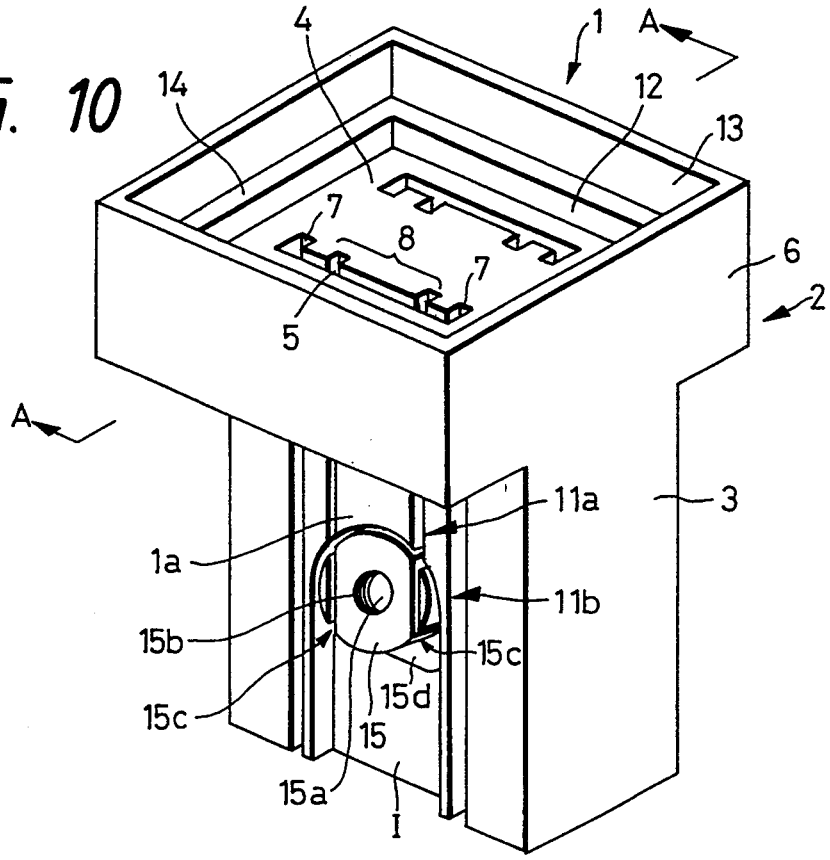
FIG. 10 is a perspective view of a connection box for fusible links constructed according to a second embodiment of the present invention.
Figure 12:
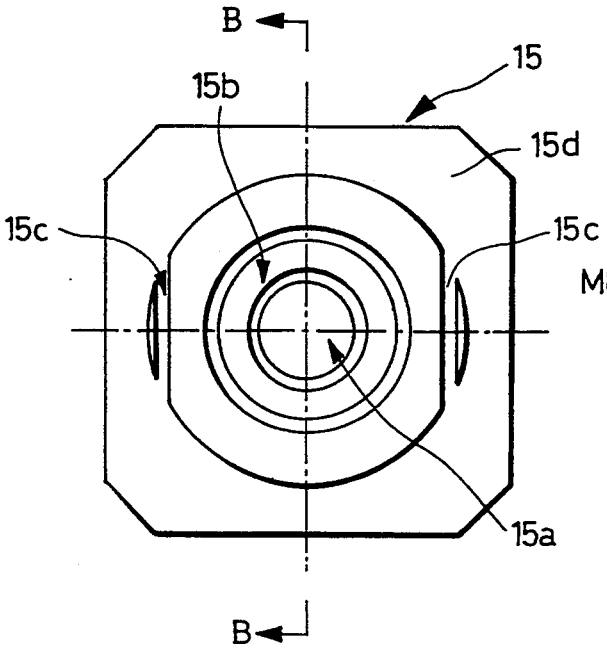
FIG. 12 is a plan view of a terminal nut to be secured to the connection box shown in FIG. 10.
Figure 13:
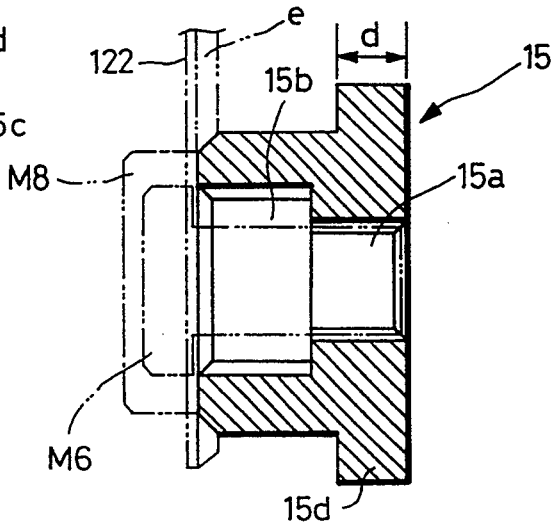
FIG. 13 is a sectional view of the terminal nut taken along line B—B in FIG. 12.
Figure 11:
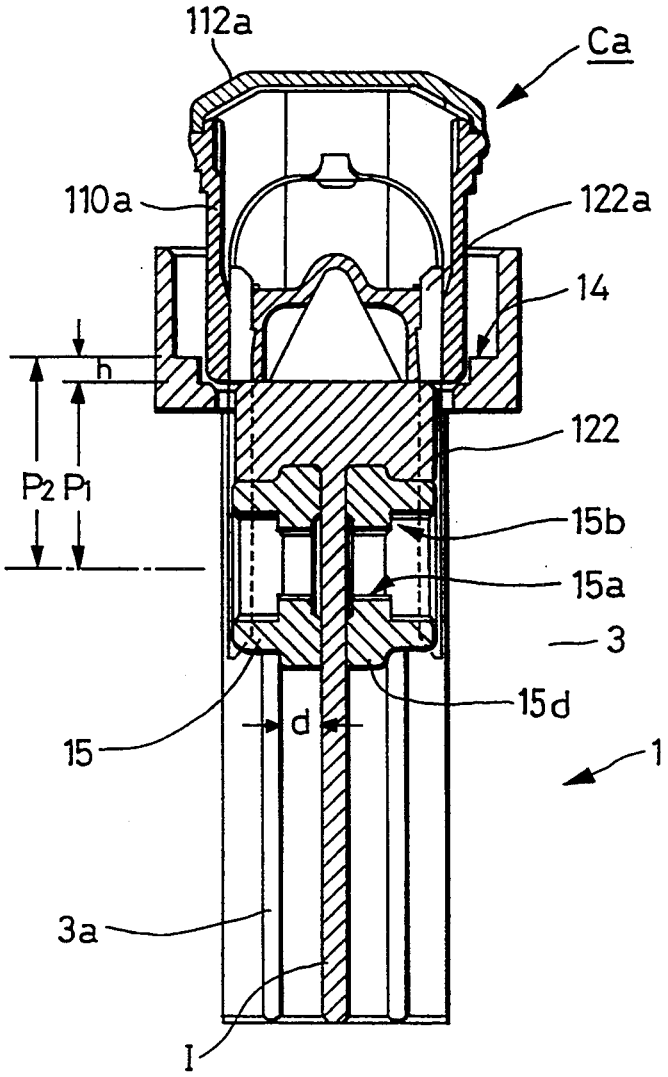
FIG. 11 is a sectional view of the connection box taken along line A—A in FIG. 10.

FIG. 10 is a perspective view of a connection box for which terminal nuts constructed according to the second embodiment of the present invention are employed, FIG. 11 is a sectional view of the connection box taken along line A—A in FIG. 10, FIG. 12 is a plan view of a terminal nut constructed according to the second embodiment of the present invention, and FIG. 13 is a sectional view of the terminal nut taken along line B—B in FIG. 12. Incidentally, since the connection box is substantially coincident with the conventional connection box described above with reference to FIG. 1 to FIG. 3 in structure with the exception of a fusible link and terminal nuts, same components as those constituting the conventional connection box are represented by same reference numerals for the purpose of convenience. Thus, repeated description on these components will not be required.

In FIG. 10 and FIG. 11, each terminal nut is generally designated by reference numeral 15. A female-threaded hole 15*a* having a small diameter and a female-threaded hole 15*b* having a large diameter are formed through the terminal nut 15 in the concentric relationship, and a pair of slits 15*c* are formed on the terminal nut 15 while extending in parallel with each other. A flange portion 15*d* of the terminal nut 15 having a predetermined thickness d is press-fitted from below between a central wall I of a connection box 1 and a rib 3*a* projected inside of a vertical wall portion 3. The terminal nut 15 is always located at a predetermined position in the connection box 1 by bringing the terminal nut 15 in contact with a fitting portion 1*a* of the connection box 1.

A connecting plate 122*b* of the large-sized fusible link Cb has an effective foot length $P_2$ which is dimensioned to be smaller than an effective foot length $P_1$ of the small-sized fusible link Ca, and a dimensional difference h between both the effective lengths $P_2$ and $P_1$ is determined depending on the position where a circular hole f formed through the connecting plate 122*b* is positionally aligned with the terminal nut 15 when a housing 110*b* of the large-sized fusible link Cb is placed on a stepped part 14 of the connection box 1. With this construction, the position where each of the connecting plates 122*a* and 122*b* of the small-sized fusible link Ca and the large-sized fusible link Cb is secured to the connection box 1 is positionally coincident with the upper end of the terminal nut 15 while each of the connecting plates 122*a* and 122*b* is flush with the outer surface of the terminal nut 15.

In case that the small-sized fusible link Ca is fitted to the connection box 1, connecting plates 122*a* of the small-sized fusible link Ca are inserted through common slots 5 and first transverse slot portions 8 from above until the lower end of a housing 110*a* comes in contact with a bottom wall 4 of the connection box 1, whereby ribs e at the opposite ends of each connecting plate 122*a* are inserted into the slits 15*c* on the terminal nut 15 via guide grooves 11*a* to reach predetermined positions. Subsequently, while a cable terminal (not shown) is attached to the connecting plate 122*a*, a M6 bolt having a diameter of 6 mm is threadably fitted into the female-threaded hole 15*a* through the cable terminal so that the small-sized fusible link Ca is fixedly secured to the connection box 1 together with both cable terminals.

Next, in case that the large-sized fusible link Cb is fitted to the connection box 1, connecting plates 122*b* of the small-sized fusible link Cb are inserted through the common slots 5 and second transverse slot portions 7 from above until the lower end of a housing 110*b* of the large-sized fusible link Cb comes in contact with a stepped part 14 in the housing 110*b*, whereby ribs e at the opposite ends of each connecting plate 122*b* are inserted into the guide grooves 11*b* to reach the position where a circular hole f formed through the connecting plate 122*b* is positionally aligned with the center of the female-threaded hole 15*b* in the terminal nut 15. Subsequently, while a cable terminal (not shown) is attached to the connecting plate 122*b*, a M8 bolt having a diameter of 8 mm is threadably fitted into the female-threaded hole 15*b* so that the large-sized fusible link Cb is fixedly secured to the connection box 1 together with both cable terminals.

As shown in FIG. 12 and FIG. 13, the terminal nut 15 constructed according to the second embodiment of the present invention is designed in the form of a so-called double nut including a female-threaded hole 15*a* having a small diameter and a female-threaded hole 15*b* having a large diameter in the concentric relationship. In addition, a pair of slits 15*c* are formed on the terminal nut 15 so as to allow ribs e at the opposite ends of each connecting plate 122*a* of the small-sized fusible link Ca to extend therethrough until they come in contact with the upper end of the terminal nut 15. Incidentally, ribs e at the opposite ends of each connecting plate 122*b* of the large-sized fusible link Cb are inserted through the guide grooves 11*b* each located outside of the terminal nut 15.

In this embodiment, in case that the small-sized fusible link Ca having a small electric current capacity is fixedly secured to the connection box 1, a M6 bolt having a diameter of 6 mm is usually threadably fitted into the small female-threaded hole 15*a* with a predetermined magnitude of tightening torque. In case that the large-sized fusible link Cb having a large electric current capacity is fixedly secured to the connection box 1, a M8 bolt having a diameter of 8 mm is usually threadably fitted into the large female-threaded hole 15*b* with a predetermined magnitude of tightening torque.

As is apparent from the above-description, according to the second embodiment of the present invention, slits are formed on each terminal nut corresponding to ribs formed at the opposite ends of each connecting plate of the small-sized fusible link, and guide grooves are formed on each side wall surface of the connection box corresponding to ribs formed at the opposite ends of each connecting plate of the large-sized fusible link. Thus, when one of at least two kinds of fusible links each having a different rated electric current capacity is firmly fitted to the connection box, there does not arise a necessity for selecting terminal nuts exclusively usable for the foregoing kind of fusible link. This leads to the result that each fusible link fitting operation can be achieved at a high efficiency. In addition, when the foregoing kind of fusible link is to be replaced with other kind of fusible links, it is not necessary that the terminal nuts are replaced with another ones. Thus, since different kinds of fusible links can be handled merely with a single kind of terminal nuts, each fusible link fitting operation can be achieved at an improved efficiency. Further, since storage of components constituting the connection box can be achieved merely with an approximately half of the manhours required for the conventional connection box, each fusible link unit can be assembled at a reduced cost.

What is claimed is:

1. A connector for accommodating first and second fusible links of different sizes, said fusible links including a housing portion having a fuse therein and a pair of feet extending from the housing portion, each said feet including at least one alignment rib, said connector comprising:

a housing including a peripheral wall and a bottom surface, said bottom surface having a pair of opposing slots each having at least a pair of rib-receiving slots for receiving the alignment ribs of said first and second fusible links respectively, said peripheral wall having at least one stepwise recess which, in cooperation with said bottom surface, define first and second abutting portions against which said first and second fusible links respectively abut when individually accommodated in said housing; and a wall member extending from said housing, said wall member having a pair of terminal nuts for individually securing said fusible links with a bolt.

2. The connector of claim 1, wherein the alignment ribs are located in different positions for said first and second fusible links.

3. The connector of claim 1, wherein said each terminal nut is detachably provided to said wall member, said terminal nut has recesses for individually receiving said fusible links with a predetermined distance therebetween, and said predetermined distance corresponds to a distance between said alignment ribs provided with said fusible links.

* * * * *